US008631627B2

(12) United States Patent
Atchley

(10) Patent No.: US 8,631,627 B2
(45) Date of Patent: Jan. 21, 2014

(54) HELICAL POLE SUPPORT BRACKET AND METHOD FOR SUPPORTING A POLE

(75) Inventor: Jacob C. Atchley, Columbia, MO (US)

(73) Assignee: Hubbell Incorporated, Shelton, CT (US)

( * ) Notice: Subject to any disclaimer, the term of this patent is extended or adjusted under 35 U.S.C. 154(b) by 24 days.

(21) Appl. No.: 13/335,334

(22) Filed: Dec. 22, 2011

(65) Prior Publication Data

US 2013/0160380 A1 Jun. 27, 2013

(51) Int. Cl.
*E04G 21/00* (2006.01)

(52) U.S. Cl.
USPC ..... 52/741.11

(58) Field of Classification Search
USPC ..... 52/741.11, 741.14, 745.17, 745.18, 52/831, 832, 836, 848, 849, 851, 853
See application file for complete search history.

(56) References Cited

U.S. PATENT DOCUMENTS

| | | | | |
|---|---|---|---|---|
| 108,814 | A * | 11/1870 | Moseley | 405/222 |
| 4,833,846 | A | 5/1989 | McFeetors et al. | |
| 5,066,168 | A * | 11/1991 | Holdeman | 405/249 |
| 5,108,068 | A | 4/1992 | Gingras | |
| 5,919,005 | A * | 7/1999 | Rupiper | 405/244 |
| 6,234,719 | B1 | 5/2001 | Roynestad | |
| 6,328,273 | B1 | 12/2001 | Kemikem | |
| 6,641,332 | B1 * | 11/2003 | Alvarado | 405/232 |
| 6,652,195 | B2 * | 11/2003 | Vickars et al. | 405/239 |
| 6,722,821 | B1 | 4/2004 | Perko et al. | |
| 7,241,079 | B2 | 7/2007 | Francis | |
| 7,494,299 | B1 * | 2/2009 | Whitsett | 405/254 |
| 7,497,053 | B2 | 3/2009 | Nicolet | |
| 7,621,098 | B2 | 11/2009 | Reinert, Sr. | |
| 2008/0175673 | A1 | 7/2008 | Roberts et al. | |
| 2008/0181729 | A1 | 7/2008 | Van Horn et al. | |

* cited by examiner

*Primary Examiner* — Mark Wendell
(74) *Attorney, Agent, or Firm* — Garrett V. Davis; Mark S. Bicks; Alfred N. Goodman

(57) ABSTRACT

A method of installing a support structure is provided for use in soft or unstable soil. The method forms a hole in the earth to a depth sufficient to support the structure, such as a utility pole or post. A pole support is placed in the hole and driven downward into the earth to form a supporting base at the bottom of the hole. The pole support in one embodiment has a helical screw at a bottom end and a flat supporting plate at the top end. The pole support is rotated by a drive member into the earth to position the support plate at the bottom of the hole. The support plate can have a hole in the top face to receive the drive member for rotating the support member to drive the screw into the earth. The drive member is then separated and lifted from the hole. The pole or post is positioned on the support plate and the hole is back-filled.

20 Claims, 5 Drawing Sheets

HELICAL POLE SUPPORT BRACKET AND METHOD FOR SUPPORTING A POLE

FIELD OF THE INVENTION

The present invention is directed to a helical pole support bracket and to a method of installing and supporting a pole in the ground using the pole support bracket. The invention is particularly directed to a method for installing and supporting a support pole in soft or unstable soils in a manner to adequately stabilize the support pole.

BACKGROUND OF THE INVENTION

Support systems and piles are known for use in supporting a building or other structure in unstable soil. The support systems typically have a base that is placed in the ground and has a top end that can support building. The top end of the support system can be positioned below ground level or above ground level.

Support systems are often used in sand or soft soil that is not able to support a building or support structure such that the building can sink or shift over time. The support systems can be used in new construction or existing buildings to level the building. The support systems have a bottom end with a foot or blade extending outward to penetrate the ground below the building and provide a more stable footing for the building.

Various devices are known in the art for supporting a pole. One example is disclosed in U.S. Pat. No. 5,108,068 to Gingras. This system places a camming plate bearing in the bottom of a hole formed in the ground. The anchoring assembly includes a threaded shaft that is connected to the camming plate. A collar with a plurality of ground engaging legs is lowered onto the bearing plate. The shaft is rotated to cause the collar and blades to engage the camming plate and cam the blades outward into engagement with the sides of the hole. A second collar assembly is then placed on the shaft and actuated to extend the anchor blades outward. A pole can then be passed through the upper collar and into the lower collar. This assembly is complicated and requires specialized toolings to install the system.

U.S. Pat. No. 4,833,846 to McFeetors et al. discloses a ground screw anchor system for an above ground structure. The support includes a helical pile and a blade. A head member having a generally T-shaped cross-section is attached to the top end of the support structure.

U.S. Pat. No. 6,234,719 to Roynestad discloses a method of inserting a tubular base into the ground using a drilling rig. A pile can be inserted into the hole and rammed down to the bottom of the bore hole.

U.S. Pat. No. 6,328,273 to Kemikem discloses a pole mount for a satellite dish. The mount includes a helical screw pile and a top stabilizing plate. A support pole is attached to the top plate above the ground.

U.S. Pat. No. 6,641,332 to Alvarado discloses a foundation support including a helical pile that is driven into the ground. The pile is placed in the bottom of a trough or channel for forming the foundation or footing of the building. A top plate is attached to the top end of the pile within the trough for forming the foundation.

U.S. Pat. No. 6,722,821 to Perko et al. discloses a helical pier post. The support includes a helical screw, a cylindrical tube or post positioned at the ground surface, and a top plate for connecting to the structure being supported.

U.S. Pat. No. 7,241,079 to Francis discloses a pier that is driven into the ground. The pier includes an auger that is driven into the ground. A compaction member having a sleeve fits over the shaft of the auger member which is driven into the ground.

U.S. Pat. No. 7,497,053 to Nicolet discloses a foundation support having expandable legs that are forced outward into the soil.

U.S. Pat. No. 7,621,098 to Reinert, Sr. discloses a foundation support that is placed in the bottom of a hole. The support includes expandable plates that pivot outwardly to engage the sides of the hole.

U.S. Patent Publication No. 2008/0181729 to Van Horn et al. discloses a bracket for a deep foundation construction system. The apparatus includes a helical screw that is connected to an adapter. The adapter slides onto the end of the auger and includes a flat top plate for connecting to the building structure.

U.S. Patent Publication No. 2008/0175673 to Roberts et al. discloses a foundation lifting assembly including an anchoring bracket that is mounted to a piling or pier that has been driven into the ground. A jacking assembly includes a bottom plate on the upper end of the vertical support column. Concrete is formed into the foundation mold around the anchoring bracket.

While these anchoring systems are generally suitable for their intended purpose, many of the systems are complicated to install and use and require specialized tools. Thus, there is a continuing need in the industry for improved support and anchoring systems.

SUMMARY OF THE INVENTION

The present invention is directed to a support system that can be inserted or driven into the ground to support a structure or device such as a utility pole. The invention is particularly directed to a method of installing and supporting a pole in the ground.

One object of the invention is to provide a method for installing and stabilizing a support structure such as a pole in soft and unstable soil.

One feature of the invention is to provide an assembly for installing in the ground to support a pole such as a utility pole. The assembly includes a pole support that is driven into the bottom of a hole formed in the ground and a pole that can be positioned on the pole support within the hole to support and stabilize the pole.

Another feature of the invention is to provide a pole support that can be positioned at the bottom of a hole formed in the ground to support and stabilize a support pole.

A further feature of the invention is to provide a pole support having a ground engaging bottom end and a support plate at a top end where the pole support can be driven into the hole formed in the ground using standard drilling equipment and without the need for specialized equipment.

Another feature of the invention is to provide a pole support having a shaft with a ground engaging end, a helical screw on the ground engaging end, and a top end with a support plate. The support plate is preferably a flat plate having a substantially planar surface with a dimension sufficient to support a pole in soft or unstable soil.

The pole support of the invention in one embodiment has a support plate with a planar top face and a coupling member that can engage a drive tool to drive the pole support into the ground. The coupling member can be a hole in the support plate to receive the drive tool and easily disengage from the drive tool when the support plate is driven into the ground. In one embodiment, the hole in the support plate generally has a square or hexagonal shape to interlock with a corresponding shaped drive tool. The hole and the shaft can have any suitable shape that enables interlocking between components.

The invention is particularly directed to a method of installing and stabilizing a support pole such as a utility pole in soft or unstable soil. The method forms a hole in the ground to a depth for supporting the pole and drives the pole support into the ground at the bottom of the hole. A pole is inserted into the hole onto the pole support. The hole is back-filled around the pole to stabilize the pole.

These and other objects, advantages and features of the invention are basically attained by providing a method for the installation of a support pole in the earth. The method comprises the steps of forming a vertical hole in the ground with a depth sufficient to stabilize and support the pole. A pole support is provided having a shaft with a bottom end, a top end, a helical screw on the shaft at the bottom end, a support plate at the top end with a dimension sufficient to support the pole, and a coupling member at the top end. A drive member is coupled to the coupling member and drives the pole support into the earth at a bottom end of the hole to position the support plate at the bottom end of the hole. The support pole is inserted into the vertical hole with a bottom end of the pole support supported by the support plate. The vertical hole is back-filled with earth around the pole support to stabilize the pole support.

The various features of the invention are also attained by providing a method for the installation of a support pole in the earth for supporting a device above ground. The method comprises the steps of forming a hole in the ground. The hole has a depth sufficient to support the pole and has a bottom end. A pole support is driven into the bottom end of the hole and into the earth. The pole support has a bottom end with a helical screw adapted for driving into the ground and a top end with a support plate. The pole support is driven into the ground to position the support plate on the bottom end of the hole below a surface of the earth. The pole is positioned on the support plate within the hole. The support plate has a diameter greater than a diameter of the pole. The hole is back-filled with earth around the pole and onto the support plate extending beyond the perimeter of the pole to stabilize the pole.

The features of the invention are further attained by providing a support assembly for supporting a device above ground. The assembly comprises a utility pole having a longitudinal dimension with a top end and a bottom end. The bottom end is adapted for positioning in the ground at a depth sufficient for supporting and stabilizing the utility pole and the device. A pole support having a shaft with a bottom end with a helical screw is adapted for driving into a bottom end of a hole formed in the ground. A top end with a support plate has a top face with a diameter greater than a diameter of the pole. The top face of the support plate has a coupling member for removably coupling with a rotary drive member.

The objects and advantages of the invention will become apparent from the following detailed description of the invention which taken in conjunction with the annexed drawings disclose various embodiments of the invention.

BRIEF DESCRIPTION OF THE DRAWINGS

The following is a brief description of the invention, in which.

DETAILED DESCRIPTION OF THE INVENTION

Figure 1:
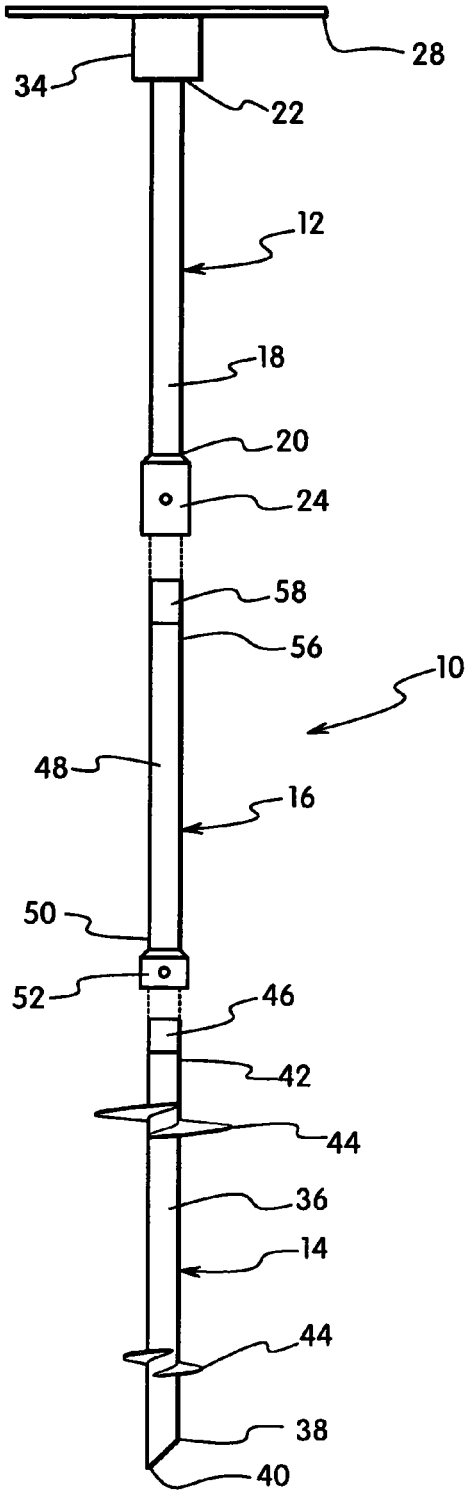
FIG. 1 is an exploded elevational view of the pole support assembly in one embodiment of the invention.

The present invention is directed to a support assembly that can be driven into the ground to support a structure. The invention is particularly directed to a method of installing a vertical support member or support pole such as a utility pole in soft and unstable soil by driving a support assembly into the ground and positioning the support on the support assembly.

Referring to the drawings, the support assembly 10 of the invention is adapted for driving into the ground to a depth sufficient to support a support member such as a pole. The support assembly 10 in one embodiment of the invention has a helical screw formed at a bottom end and a top end for supporting the pole or other support member.

Referring to FIG. 1, the support assembly 10 in a preferred embodiment of the invention includes a pole support 12 adapted for coupling to a screw anchor 14 or lead section. In the embodiment shown, an extension rod 16 is connected to the pole support 12 and the screw anchor 14 to increase the length of the assembly as needed. One or more extension rods 16 can be used to modify the length for driving the screw anchor to a depth sufficient to provide a stable support. The length can vary depending in the soil conditions, depth of the hole and the subsoil below the bottom of the hole. The extension rods 16 generally have a length of about 3-5 feet.

Figure 3:
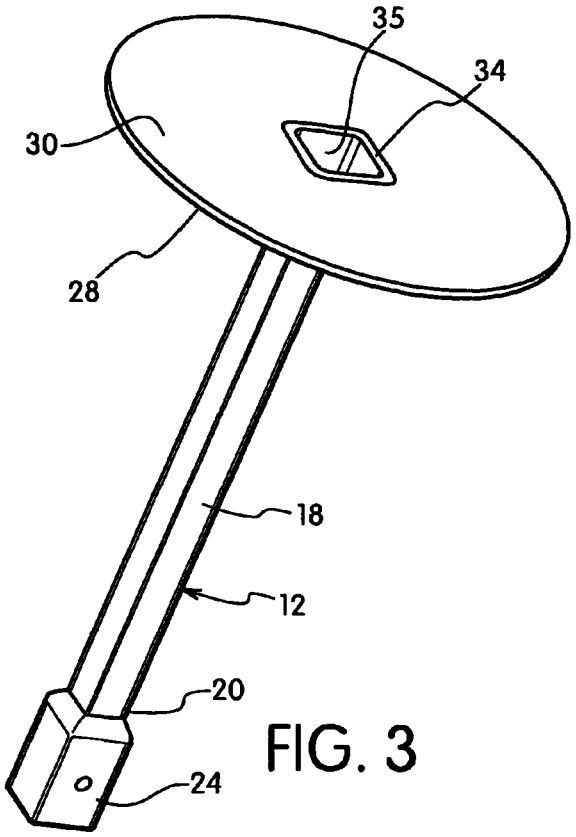
FIG. 3 is a perspective view of the pole support.
Figure 4:
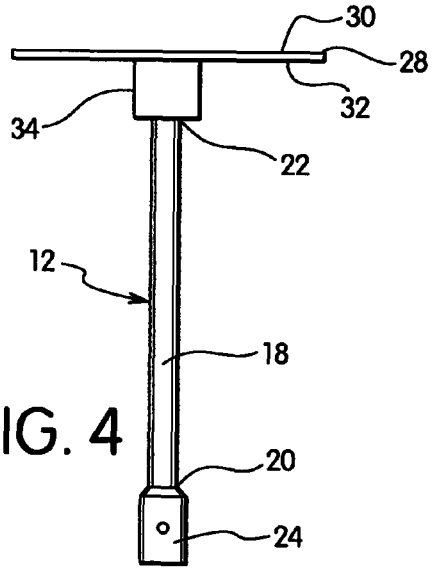
FIG. 4 is a side view of the pole support.
Figure 5:
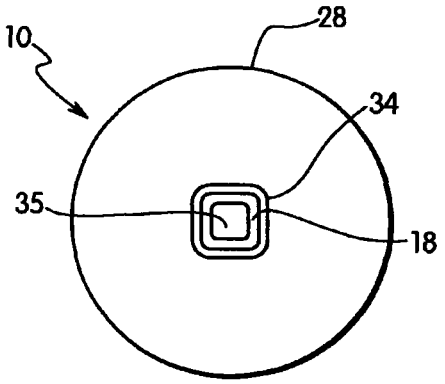
FIG. 5 is a top view of the pole support.

Pole support 12 as shown in FIGS. 3-5 includes a longitudinal shaft 18 having a bottom end 20 and a top end 22. The bottom end includes a coupling member 24 adapted for coupling to either the extension rod 16 or the screw anchor 14. The coupling member 24 in the embodiment shown has a sleeve with an open bottom end defining a recess forming a socket for coupling with an end of the extension 16 or screw anchor 14. In the embodiment shown, the socket has a substantially square cross-section. The socket recess is adapted for coupling with an end 58 of the extension rod 16 or end 46 of the screw anchor 14 as shown. The socket and coupling ends of the extension 16 and screw anchor 14 in the illustrated embodiment have a substantially square cross-section to provide a suitable connection for rotating and driving the screw anchor into the ground. The coupling ends can have other shapes that provide a suitable connection for driving the screw anchor.

The top end 22 of the shaft 18 is coupled to a support plate 28 formed perpendicular to the axis of the shaft 18. The support plate 28 in the embodiment shown has a circular configuration with a diameter sufficient to support the pole or other support member. Preferably, the support plate 28 has a diameter greater than the outer diameter of the pole or support member. Support plate 28 is shown as a flat plate having a substantially flat planar top surface 30 and a flat planar bottom surface 32. A collar 34 is integrally formed with the support plate 28 for coupling with the shaft 18. In the embodiment shown, the shaft 18 extends through the collar 34 of support plate 28 and is welded to the collar and support plate. Alternatively, the shaft 18 can be fixed to the support plate 28 by a pin extending through a hole in the collar 33 and the shaft 18. As shown in FIG. 3, the collar 34 extends through a hole formed in the support plate 28 and is coupled thereto by welding. In one embodiment, the support plate 28 and shaft 18 are formed as a one piece unitary member.

The shaft 18 as shown has a square cross-section received in the recess of the collar 34, although the shaft can be round, hexagonal or other suitable shape. Preferably, the top end 22 of the shaft 18 does not extend above the top surface 30 of the support plate 28 so that the support plate 28 forms a flat supporting surface. The collar 34 has a recess 35 with a dimension to couple with a drive tool. In the embodiments shown, the recess 35 has a square cross-section for mating with the end of a drive tool. The recess 35 can have any suitable shape capable of mating with the drive tool. Preferably, the top end of the shaft 18 is below the top end of the collar 34 to form the recess 35. The recess 35 forms a drive socket.

The screw anchor 14 as shown in FIG. 1 has a longitudinal shaft with a bottom ground engaging end 38 forming a tip 40 and a top end 42. A helical screw 44 is provided on the shaft 36 for driving into the ground and anchoring the assembly. In the embodiment shown, a pair of helical screws 44 are provided that are spaced apart a distance for anchoring and supporting the assembly. The dimensions of the helical screw 44 can have a diameter of about 12 to 24 inches, although the diameter can vary depending on the soil conditions and the device being supported. A plurality of helical screws can be mounted on the shaft having different diameters as known in the art. Alternatively, the helical screw can be a single continuous helical screw with a constant diameter or a varying or graduated diameter. The dimensions of the helical screws, the number of helical screws and the spacing between the helical screws can be selected based on the soil conditions, desired depth of penetration and device being supported. The top end 42 of the shaft 36 has a square head 46 for coupling with the recess 26 of the coupling member 24 of the pole support 12 or to the extension rod 16.

Figure 2:
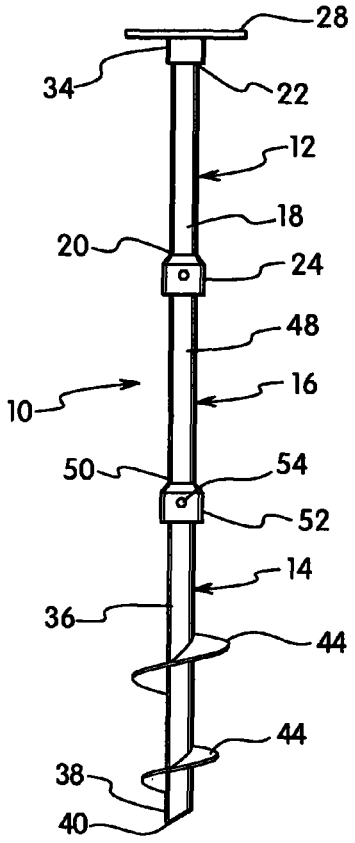
FIG. 2 is an elevational view of the assembly pole support assembly of FIG. 1.

In the embodiment shown, the extension rod 16 is provided to increase the length of the support assembly 10 for driving the screw anchor 14 deep into the ground. The extension rod 16 has a cylindrical shaft 48 with a bottom end 50 having a coupling member 52. The coupling member 52 has an axial recess for mating with the head 46 of the screw anchor 14. As shown, the recess can have a square shape for coupling with a square head 46. The coupling member 52 can be coupled to the screw anchor 14 by the bolt or pin 54 extending through the coupling member 52. The shaft 48 has a top end 56 with a head 58 for coupling with the coupling member 24 of the pole support 12. In the embodiment of FIG. 1, the head 58 has a square cross-section for coupling with a square recess in the coupling member 52. The shaft 48 can also be coupled to the pole support 12 by a pin or bolt as shown in FIG. 2.

The longitudinal length of the screw anchor 14, extension rod 16, and pole support 12 can vary depending on the soil conditions and the intended use. Generally, each has a length of about 3 feet to about 7 feet, and the shafts have a width of about 2 to 3 inches.

Figure 7:
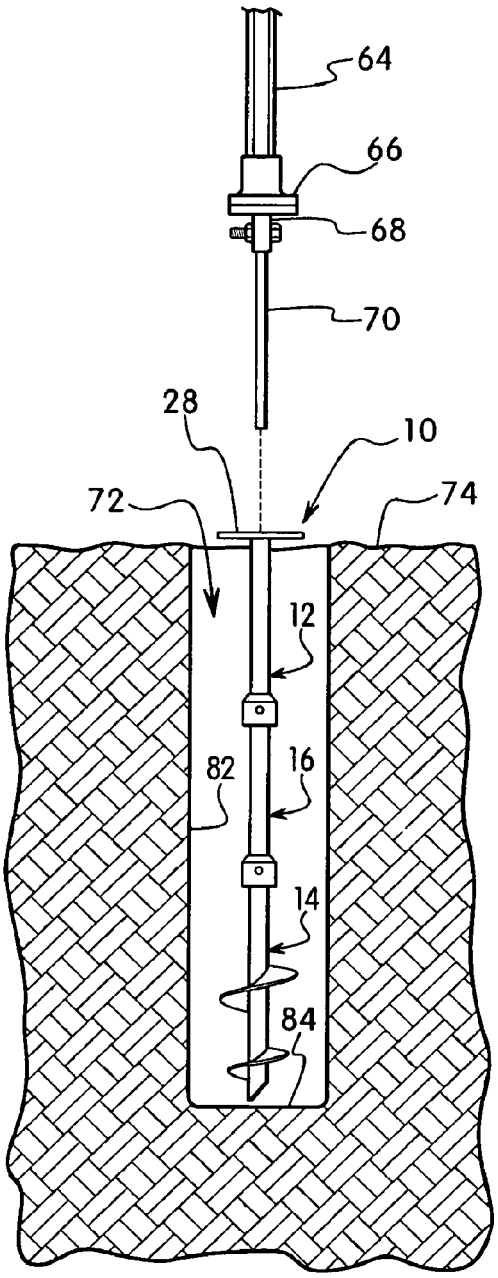
FIG. 7 is a side view of the pole support assembly positioned in the hole formed in the ground for connecting to the drive assembly.

The support assembly 10 is adapted for use with a drive assembly 60 as shown in FIG. 7. The drive assembly 60 includes a drive mechanism 62 for rotating a drive shaft 64. In the embodiment shown, the draft shaft 64 is a Kelly bar having a hexagonal cross-section. A Kelly bar adapter 66 is coupled to the end of the shaft 64. In the embodiment shown, the Kelly bar adapter 66 has a bottom end 68 having a square recess forming a drive socket. As shown in FIG. 7, a connecting rod 70 having a square cross-section is coupled to the bottom end 68 of the Kelly bar adapter 66. The connecting rod 70 has a dimension for mating with the drive socket 35 of the pole support 12. Other drive assemblies can also be used that enable quick and easy disconnecting with the support assembly. Preferably, the drive assembly can be removably coupled with the drive assembly without the use of tools so that the drive assembly can be disconnected from the support assembly after the support assembly is driven into the ground at the bottom of the hole. Preferably, the coupling mechanism allows separation of the support assembly while providing a flat surface on the support plate 28 for the pole.

The pole support assembly 10 of the invention is particularly adapted for use with existing drilling equipment that is commonly used in the field for installing utility poles. The assembly 10 does not require specialized tooling or additional equipment for installing and driving into the ground. The support plate 28 and the helical screws 44 have dimensions that enable the assembly to support the intended structure. The assembly 10 has a length to drive the screw anchor 14 into the ground to a depth below the bottom of the hole where the screw anchor can stabilize the support pole.

Figure 6:
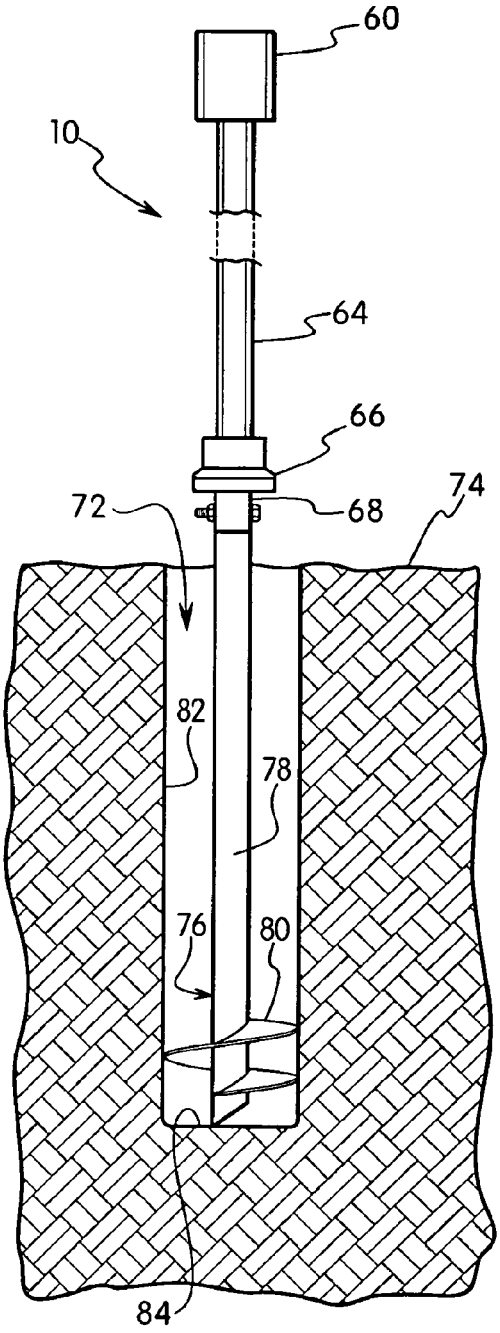
FIG. 6 is a side view of the auger and drive assembly for forming a hole in the ground.

The method for installing the pole support is shown in FIGS. 6-11. A hole 72 is formed in the ground 74 as shown in FIG. 6 using an auger 76. The auger 76 has an elongated shaft 78 with helical screws 80. The shaft 78 is coupled to the Kelly bar adapter 66 and rotated by the drive mechanism to form the hole 72 having a depth and width sufficient to support the pole support. Typically, the hole 72 has a depth of about 5 feet although the depth can more or less depend on the soil conditions and the pole being supported. The auger 76 forms the hole having a substantially cylindrical shape having sides 82 and a bottom 84.

Figure 8:
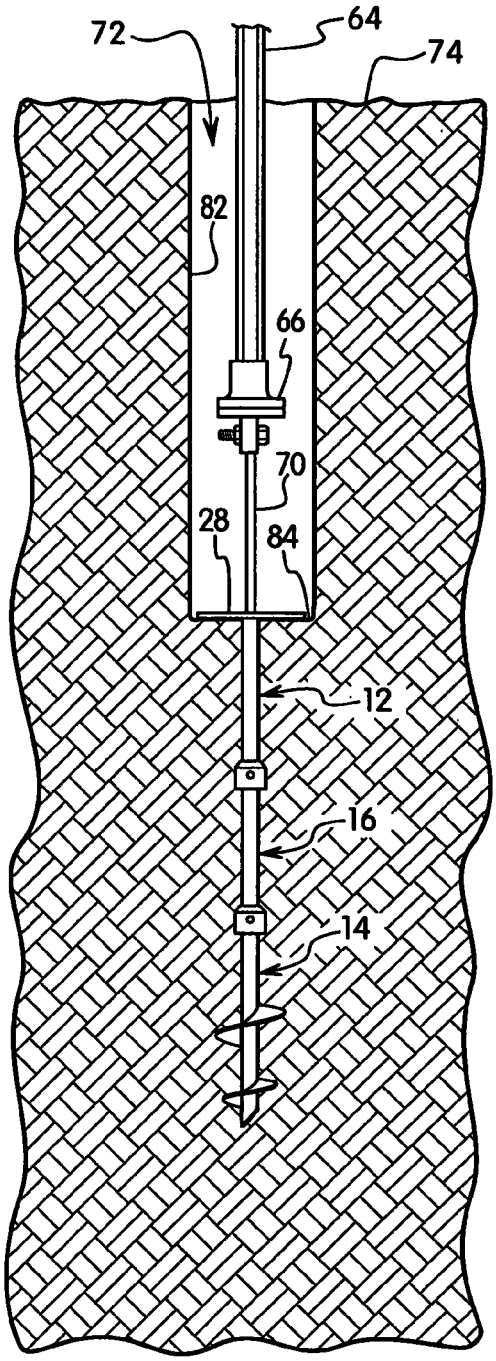
FIG. 8 is a side view showing the pole support assembly driven into the ground within the hole.
Figure 9:
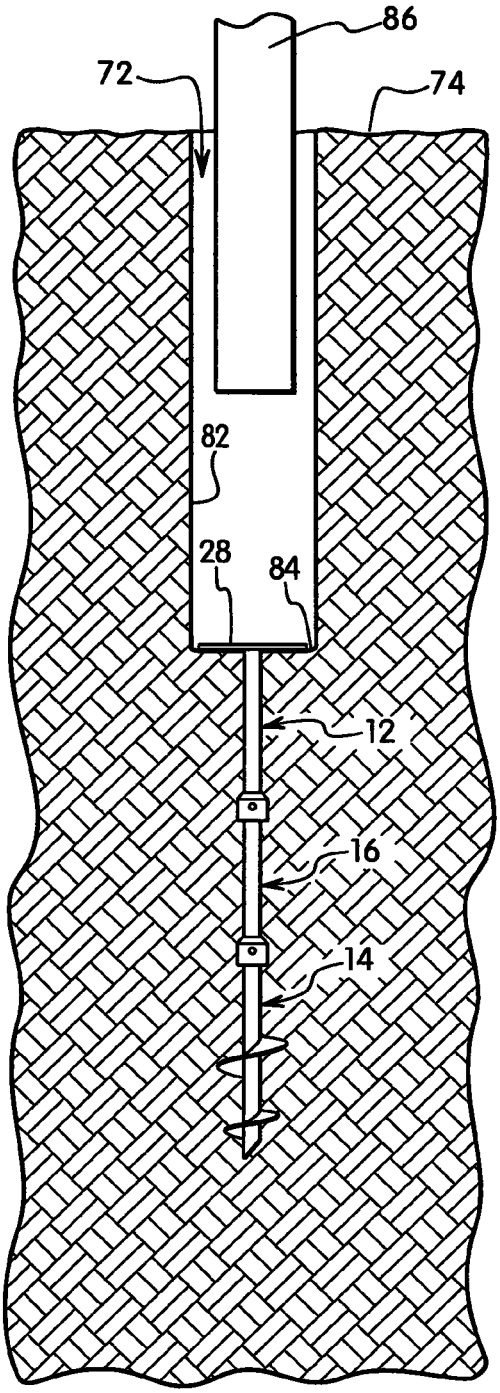
FIG. 9 is a side view showing the pole support assembly embedded in the ground.

The auger 76 is lifted from the hole 72 and the auger separated from the drive assembly 60. The support assembly 10 is then lowered into the hole 72 against the bottom 84 of the hole as shown in FIG. 7. The support assembly 10 can be lowered manually or by use of a crane or hoist as needed. The connecting rod 70 is coupled to the Kelly bar adapter 66 and inserted into the drive socket 34 of the pole support 12. The drive assembly 60 is actuated to rotate the support assembly 10 and drive the screw anchor 14 into the ground at the bottom 84 of the hole 72 as shown in FIG. 8. The support assembly 10 is driven into the ground until the support plate 28 rests flush with the bottom 84 of the hole 72 as shown in FIG. 8. The screw anchor 14 is preferably driven into the ground a depth sufficient to anchor the support assembly and to support the weight of the pole support to reduce sinking or movement in soft and unstable soil. The connecting rod 70 can be lifted upwardly to separate the connecting rod 70 from the drive socket 34 leaving the support assembly 10 in the hole 72 as shown in FIG. 9 with the support plate 28 resting flush at the bottom 84 of the hole. Preferably, the support plate 28 has a diameter substantially equal to or slightly less than the diameter of the hole 72 so that the support plate can rest on the bottom of the hole.

Figure 10:
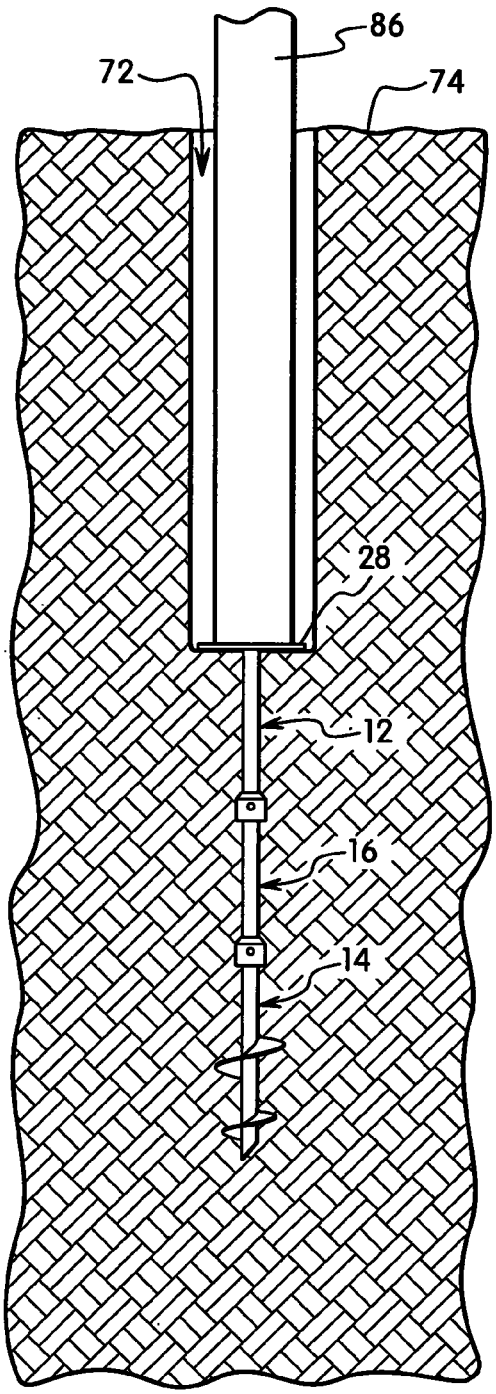
FIG. 10 is a side view showing the pole positioned on the pole support.
Figure 11:
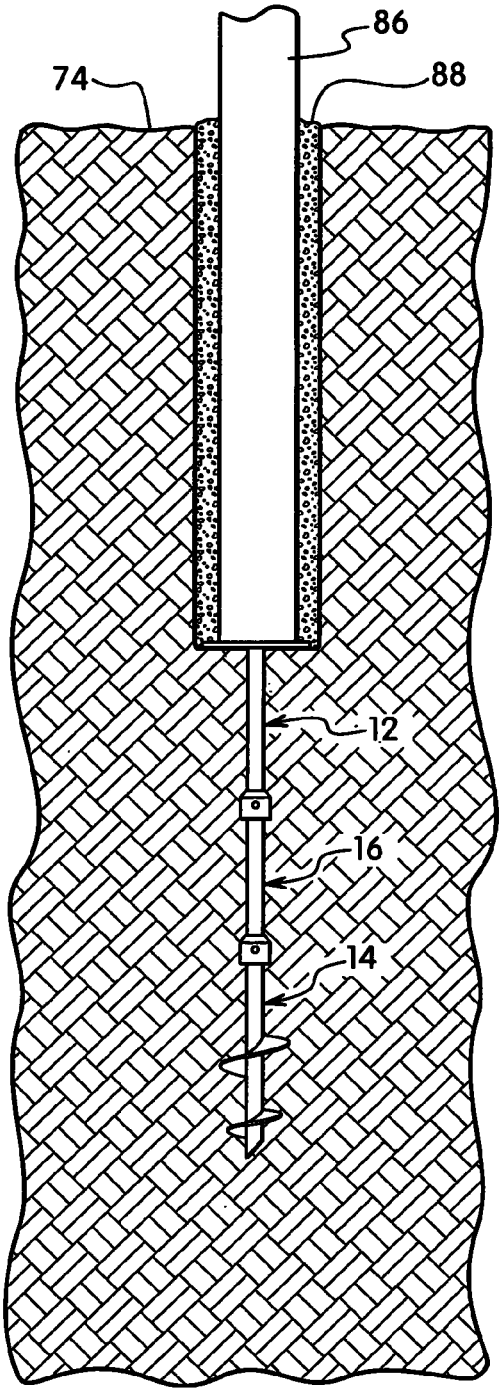
FIG. 11 is a side view showing the hole back-filled to support the pole.

Referring to FIGS. 9 and 10, a pole 86 is lowered into the hole 72 to sit directly on the substantially flat top face of the support plate 28. As shown, the support plate 28 has a diameter greater than the diameter of the pole 86. Preferably, the support plate 28 has a flat surface with no protrusions that would interfere with the pole resting on the support plate. The pole 86 is supported by the support assembly to stabilize the pole and prevent the pole from sinking into soft or unstable soil. The hole 72 is back-filled with dirt 88 as shown in FIG.

11 and compacted around the pole 86. The compaction of the back-fill 88 around the pole and the support assembly stabilizes the pole sufficiently to resist movement of the pole in the ground. The support plate 28 preferably has a width to adequately support the weight of the pole 86. The support plate 28 and the screw anchor 14 have dimensions to complement each other and provide a stable base for the pole 86 and stabilize the pole in unstable soil conditions.

The pole 86 can be a cylindrical utility pole as known in art that is commonly embedded in the ground. The pole 86 can also have a non-circular cross-section depending on the intended use of the pole. The pole can also be any suitable support member that is adapted for supporting a structure or device above ground. In one embodiment, the pole is a utility pole for supporting electrical wires and equipment above ground.

The support assembly 10 can be provided with a pole 86 as a unit or kit. The support assembly 10 is advantageous in that it can be used with existing equipment used to drill the hole in the ground and for positioning the pole in the resulting hole. The drive mechanism of the drilling auger for forming the hole can be easily connected to the support assembly without additional or specialized equipment. In addition, the support assembly can be driven into the ground at the bottom of the hole and the drive mechanism easily disconnected and lifted from the hole without the need for specialized couplings to release the drive mechanism from the support assembly.

In the embodiment shown, the drive assembly includes a square drive head that is positioned in the drive socket of the support assembly such that the drive assembly can be lifted to separate the drive assembly from the support assembly. Alternatively, a threaded screw connection can be provided between the support assembly and the drive assembly. The drive assembly can be rotated in a reverse direction to unscrew the threaded shaft from the support assembly.

While various embodiments have been chosen to illustrate the invention, it will be understood by those skilled in the art that various changes and modifications can be made without departing from the scope of the invention as defined in the appended claims.

What is claimed is:

1. A method for the installation of a utility pole in the earth, the method comprising the steps of:

forming a substantially cylindrical vertical hole in the ground having a depth sufficient to stabilize and support the utility pole;

providing a pole support having a shaft with a bottom end, a top end, a helical screw on said shaft at said bottom end, a support plate at said top end having a dimension sufficient to support the pole, and a coupling member at said top end;

coupling a drive member to said coupling member and driving said pole support into the earth at a bottom end of said hole to position said support plate at the bottom end of the hole;

separating the drive member from said coupling member and removing the drive member from the hole;

inserting the utility pole into the vertical hole with a bottom end of the pole support supported by the support plate; and back-filling the vertical hole with earth around the pole support and utility pole to stabilize the pole support and utility pole.

2. The method of claim 1, comprising forming said vertical hole with a diameter greater than a diameter of said pole support and said support plate.

3. The method of claim 2, wherein said support plate has a diameter greater than a diameter of said pole support.

4. The method of claim 3, wherein said support plate extends radially outward from said shaft to define a substantially planar top surface substantially perpendicular to a longitudinal axis of said shaft.

5. The method of claim 4, wherein said coupling member is an aperture extending through said support plate and said method further comprises inserting the drive member into the aperture to couple the drive member to the support plate of the pole support;

lowering the pole support and drive member into the vertical hole and driving the pole support into the earth at the bottom of the vertical hole; and lifting the drive member upwardly to separate the drive member from the pole support and position the support plate at the bottom of the hole.

6. The method of claim 1, wherein said pole support has a first longitudinal shaft with a top end coupled to said support plate and a bottom end; and a second shaft having a top end and a ground engaging bottom end, said bottom end having said helical screw coupled thereto, said method further comprising coupling said top end of said second shaft to said bottom end of said first shaft and driving said first shaft and second shaft into the ground to position said support plate against a bottom surface of said hole.

7. The method of claim 1, further comprising;

coupling the drive member to an auger and driving said auger into the earth to form said vertical hole, disconnecting said drive member from said auger and coupling said drive member to said pole support and driving the pole support into the earth.

8. The method of claim 1, further comprising;

driving an auger into the earth to form the vertical hole, the auger being coupled to the drive member;

withdrawing the auger from the vertical hole and disconnecting the drive member from the auger; and coupling the drive member to the pole support to drive the pole support into the earth.

9. The method of claim 8, wherein said auger has a shaft with a helical screw, and said drive member has a drive shaft removably coupled to said shaft, said method further comprising;

disconnecting said driving shaft from the auger after withdrawing the auger from hole;

coupling the driving shaft to the pole support and driving the pole support into the earth; and separating the driving shaft from the pole support and removing the driving shaft from the hole.

10. A method for the installation of a support pole in the earth for supporting a device above ground, the method comprising the steps of:

driving an auger into the ground to form a hole in the ground, said hole having a depth sufficient to support the pole and having a bottom end, the auger having a shaft with a helical screw where the shaft is removably coupled to a driving shaft;

withdrawing the auger from the hole and disconnecting the driving shaft from the auger;

coupling the driving shaft to a pole support and driving the pole support into the bottom end of the hole and into the ground, said pole support having a bottom end with a helical screw adapted for driving into the ground and a top end with a support plate, said pole support being driven into the ground to position the support plate on the bottom end of the hole below a surface of the earth;

separating said driving shaft from the pole support and removing the driving shaft from the hole;

positioning the pole on the support plate within the hole, said support plate having a diameter greater than a diameter of the pole; and back-filling the hole with earth around the pole and onto the support plate extending beyond the perimeter of the pole to stabilize the pole.

11. The method of claim 10, wherein said pole support has a coupling member, and said method comprises removably coupling a rotary drive member to said coupling member and driving said pole support into the earth and positioning said support plate on the bottom end of the vertical hole; and lifting said drive member to separate the drive member from the pole support.

12. The method of claim 11, further comprising coupling the rotary drive member to the pole support and thereafter inserting the pole support and drive member into the hole.

13. The method of claim 10, further comprising forming said hole having a diameter greater than a diameter of the pole and said support plate.

14. The method of claim 13, wherein said support plate extends radially outward from a shaft to define a substantially planar top surface perpendicular to a longitudinal axis of said shaft.

15. The method of claim 14, wherein said top surface of said support plate has an aperture defining a coupling member, said method comprising inserting a driving shaft into the aperture to couple the driving shaft to the pole support;

lowering the pole support and driving member into the hole and rotatably driving the pole support into the earth at the bottom of the hole to position the support plate on the bottom of the hole; and thereafter lifting the driving shaft upwardly to separate the drive member from the pole support.

16. The method of claim 10, wherein said pole support has a first longitudinal shaft with a top end coupled to said support plate and a bottom end; and a second shaft having a top end and a ground engaging bottom end with said helical screw, said method comprising coupling said top end of said second shaft to said bottom end of said first shaft and driving said first and second shafts into the ground.

17. A utility pole and support assembly for supporting a device above ground, said assembly comprising:

a utility pole having a longitudinal dimension with a top end and a bottom end, said bottom end being positioned in a substantially cylindrical hole formed in the ground and having a depth sufficient for supporting and stabilizing the utility pole and the device; and a pole support having a shaft with a bottom end with a helical screw driven into a bottom end of the cylindrical hole formed in the ground, and a top end with a support plate having a top face with a diameter greater than a diameter of said pole, and said top face of said support plate having a coupling member for removably coupling with a rotary drive member.

18. The assembly of claim 17, wherein said coupling member is an aperture formed in said top face, and said drive member has a shape complementing said aperture.

19. The assembly of claim 18, wherein said aperture is substantially square and said drive member has a substantially square cross section.

20. The assembly of claim 19, wherein said pole support further comprises a first shaft with a top end having said support plate and a bottom end with a coupling member; and a second shaft with a top end having a coupling member adapted for coupling with said coupling member of said first shaft and having a bottom end with said helical screw.

* * * * *